United States Patent [19]

Walther

[11] Patent Number: 4,958,776

[45] Date of Patent: Sep. 25, 1990

[54] CENTRIFUGAL-FORCE VIBRATORY GRINDING MACHINE

[75] Inventor: Henning D. Walther, Haan, Fed. Rep. of Germany

[73] Assignee: Carl Kurt Walther GmbH & Co. KG, Wuppertal, Fed. Rep. of Germany

[21] Appl. No.: 341,152

[22] Filed: Apr. 20, 1989

[51] Int. Cl.[5] ..... B02C 27/14

[52] U.S. Cl. ..... 241/171; 51/163.2; 241/175

[58] Field of Search ..... 51/163.2, 163.1; 241/175, 171, 172, 176, 182

[56] References Cited

U.S. PATENT DOCUMENTS 4,177,608 12/1979 Balz .

FOREIGN PATENT DOCUMENTS 171527 2/1986 European Pat. Off. .
232532 11/1988 European Pat. Off. .
3228658 2/1984 Fed. Rep. of Germany ..... 51/163.2
59762 4/1983 Japan .
664905 4/1988 Switzerland .

*Primary Examiner*—Mark Rosenbaum
*Attorney, Agent, or Firm*—Martin A. Farber

[57] ABSTRACT

The present invention relates to a centrifugal-force vibratory grinding machine having a container (3) which receives filling material consisting of workpieces and work bodies and the bottom (4) of which rotates relative to the container wall (5) around the axis of the container and leaves a separating gap (7) towards the container wall (5), and it proposes, in order to reduce the wear within the region of the separating gap (7), that at least one discharge element (A) is provided for the removal of particles of filling material which have penetrated into the space of the gap, which element engages into the space of the gap and rotates with the bottom (4) and/or is stationary with respect to the container wall (5).

25 Claims, 14 Drawing Sheets x
19
18
17
20
16
S
15
A
4
13
8
3
5
14
9
7
2
1

5
3
9
14
7
15
8
13
23
19
18
20
17
A
2
1
21
22
4

5
3
9
14
29
A
1
2
25
26
30
8
7
13
21
4
22

5
3
9
14
A
1
2
38
37
8
7
13
22
21
4

5
3
9
7
14
8
13
A
39
22
21
4
40
1
2

CENTRIFUGAL-FORCE VIBRATORY GRINDING MACHINE

FIELD AND BACKGROUND OF THE INVENTION

The present invention relates to a centrifugal-force vibratory grinding machine having a container which receives filling material consisting of workpieces and working bodies, the bottom of which container rotates relative to the wall of the container around the axis of the container and leaves a separating gap from the wall of the container.

From U.S. Pat. No. 4,177,608 there is known a centrifugal-force vibratory grinding machine in which the liquid (for instance, water), which is added upon the working and becomes enriched with abraded particles, discharges through the separating gap. In this case, it is not possible to prevent large particles of filling material which correspond to the width of gap from passing into the separating gap and rolling around there. This considerably increases wear, so that after a certain period of operation it is necessary to replace the bottom and/or the container, which involves a considerable expense. In order to overcome this disadvantage, various cross-sectional shapes of the separating gap and directions thereof have been selected. The results are, however, still unsatisfactory.

Furthermore, a horizontal separating gap has been selected, the size of which is adjustable (Patent EP 0 171 527). In this case, the gap-forming surfaces are formed of hard-metal rings which overlap each other. In this way, the life is increased. This, however, entails an increase in the cost of manufacture. The abrasion in the separating gap takes place regardless of the alignment of the axis of rotation of the bottom, both in the vertical and in the horizontal position.

SUMMARY OF THE INVENTION

The object of the invention is so to develop a centrifugal-force vibratory grinding machine of the type in question, in a manner which is simple to manufacture, that its life is increased as compared with the known constructions.

This object is achieved in a centrifugal-force vibratory grinding machine of this type by at least one discharge element for the removal of particles of filling material which have penetrated into the space of the gap, said element engaging into the space of the separating gap, and rotating with the bottom and/or being fastened firmly to the wall of the container.

As a result of this development, a centrifugal-force vibratory grinding machine of increased value in use is obtained. Its life is increased as compared with known embodiments. This is achieved by structurally simple means. The particles of filling material which have penetrated into the gap space have now only a short time of stay within the separating gap. They cannot be continuously carried along by friction within the separating gap and lead there to a considerable increase in the size of the gap. Rather, shortly after their entrance into the gap space, they are conducted by the discharge element preferably into the inside of the container so that they are subject to further comminution there. The comminution can possibly also be effected by the discharge element itself, so that the comminuted particles of filling material then pass through the separating gap without causing abrasion. Experiments have shown that no particles of filling material were found having a particle size which corresponds to the width of the gap on the other side of the separating gap. With respect to the discharge element, it may be an element which rotates with the bottom or is fixed to the container wall.

In principle, multiple revolution of particles of filling material within the space of the separating gap is prevented, since particles of filling material which have entered always have relative movement both with respect to the rotating bottom and with respect to the stationary container wall. The separating gap can be maintained at a predetermined size for a long period of time by the measure in accordance with the invention. Nor does the disadvantage occur that upon the working of workpieces with the addition of treatment liquid the latter leaves the container through the separating gap to an increasing extent as a result of the rapidly increasing width of the gap, which would make a corresponding feeding necessary. With the provision of a single discharge element the result is obtained that the path of travel of particles of filling material which have penetrated into the separating gap is smaller than or at most equal to 360°. If a plurality of discharge elements, preferably arranged the same angular distance apart, are provided, then the corresponding path of movement of the particles of filling material within the separating gap is reduced.

A variant is characterized by the fact that the discharge element is developed as a projection which is attached to at least one of the walls of the separating gap and protrudes into it. As soon as the projection comes against the particles of filling material, the discharge of said particles takes place in corresponding fashion.

It has been found favorable if the projection has a knife edge which is directed against the direction of movement of the particles of filling material. As soon as the corresponding particles of filling material are contacted by the knife edge, comminution down to particle size can take place in the event that the particles of filling material are fragments of abrasive grains, the fragments having a size less than the thickness of the separating gap. These comminuted particles can then pass substantially free of friction through the rest of the separating gap. If the particles of filling material which have penetrated are a workpiece or workpiece region, it or they are fed back into the inside of the container.

The life of the projections is increased if they are formed by at least one hard-metal (carbide) tip.

A double effect is obtained if the knife edge of the projection is so inclined to the plane of rotation of the bottom that the knife edge rises in the direction of rotation or opposite the direction of rotation towards the inner bottom edge. By the knife edge there is meant the one edge of the hard-metal tip which exerts a cutting function. A tapering of the knife edge of triangular cross section is not necessary but may, however, be provided. The double effect consists therein that, on the one hand, there takes place a breaking down of the corresponding particles of filling material and, as a result of the inclination, a conducting thereof then into the container. The latter occurs when the knife edge rises towards the inner bottom edge in the direction opposite the direction of rotation of the bottom. If an ascending course of the knife edge in the direction of rotation is selected, this leads to a conveying of the comminuted particles of filling material through the separating gap to the outside (and therefore out of the container). The projection which forms the knife edge can be arranged either on the bottom or on the container. The possibility then exists of providing the one projection on the bottom and the other on the container in such a manner that they do not detrimentally interfere with each other upon rotation.

Further variations are possible in the manner that at least two projections are provided in each case with knife edges which extend at such an inclination to the plane of rotation of the bottom that the one rises in direction opposite the direction of rotation and the other rises in the direction of rotation towards the inner edge of the bottom. Both knife edges can be fastened either on the bottom or on the container. An arrangement is also conceivable in which the one knife edge is located on the bottom and the other on the container.

In order to be able readily to handle particles of filling material present at different heights within the separating gap, several projections or hard-metal tips can be provided in a row, one behind the other.

It is found advantageous for the hard-metal tips to have a parallelogram-like contour so that the upper edges of the parallelogram then represent the knife edges.

One possibility of applying the hard-metal tips permanently to one of the walls of the separating gap is for the hard-metal tip to have at least one bored hole which is passed through by an attachment screw the head of which lies within a countersink in the bored hole. The attachment of the hard-metal tip and the possible replacement thereof can be easily effected in this way.

If the hard-metal tip is associated with the bottom, it is advantageous for the shaft end of the attachment screw to be screwed into a reinforcement insert of the bottom which has a plastic covering. In addition to stiffening the bottom, the reinforcement insert thus also serves to hold the hard-metal tip.

In order to optimize the attachment of the hard-metal tip, it lies in a recess in the wall of the separating gap. This recess can be located on the container (wall) and/or on the bottom.

However, the discharge element can, in advantageous fashion, also be developed as a brush extending from at least one of the walls of the separating gap. This brush also always exerts the effort of removing the particles which have entered the separating gap. Therefore, the possibility offers itself of making this brush adjustable and replaceable. In this way, there is possible an adaptation to the gap width so that, even after corresponding wear of the vessels or possibly of the walls of the separating slot, a proper position for operation is always assured.

The conveying of particles of filling material back into the inside of the container is assured due to the fact that the brush extends to the edge of the bottom.

In advantageous fashion, the brush can be arranged on a replaceable section of the wall of the separating gap, the section being held radially by means of guides and being adapted to be inserted from the lower side of the bottom. The latter facilitates the replacement and adjustment. Furthermore, no niches are produced into which the particles of filling material could enter and remain therein. The brushes have a removal effect which is similar to the abovementioned knife-edge construction.

A particularly simple solution resides therein that the container wall is traversed by at least one threaded hole which leads to the separation gap and into which a brush holder provided with an external thread and having bristles at its end where bristles are screwed. The brush holder itself can be secured against displacement by a lock nut. There is also conceivable a self-securing friction-lock arrangement of the brush holder within the threaded hole. There exists fundamentally a simple possibility of readjusting the brush holder from the outside so that the wear-proof bristles of the brush holder always extend by the corresponding amount into the separating gap. If several brush holders are arranged closely one behind the other in an ascending arrangement, a discharge effect like that of the obliquely ascending knife edge can be obtained also with them.

A further development is characterized by a brush which extends over 360°. It can be arranged on the bottom-side wall of the gap or on the container-side wall of the gap. The use of two 360° brushes (one on the bottom and the other on the container) is also conceivable.

The palette of use of the centrifugal-force vibratory grinding machine can be increased by the brushes which extend over 360° since in this way, for instance, in particular the possibility is afforded of surface-treating corresponding workpieces without working bodies since even if the workpieces should be very small or have protrusions which could enter into the gap, the gap is not subjected to any danger since the brush prevents penetration.

In order for the entrance of excessively large particles of filling material into the separating gap to be prevented, the brush can be arranged on the wall of the bottom or on the wall of the container.

As an alternative, two such brushes may also be used, one arranged on the wall of the bottom and the other on the wall of the container. The arrangement can also be one above the other.

Another possibility for the forming of the discharge element consists therein that it is a jet of water which is atomized under pressure into the gap. A partial atomization takes place here so that with the provision of a single jet of water a particle of filling material never revolves more than 90° within the separating gap.

The removal of the particles of filling material from the separating gap is particularly effective as a result of the fact that the water jet extends approximately in the direction of the separating gap.

In order, in this connection, to be able to convey the particles of filling material in all cases back into the container, alignment of the water jet in the direction towards the inside of the container is provided.

On the one hand, it is possible for the jet nozzle to be arranged fixed in position and therefore on the container itself.

On the other hand, however, there is also the possibility of having the jet nozzle rotate together with the bottom. A combination of these two possibilities is also conceivable.

If a plurality of jet nozzles connected to one distributor pipe are provided, then such an alignment can be provided that they lie one behind the other in ascending vertical order so as to increase the discharge effect of the particles of filling material which have entered the separating gap.

This latter can be achieved simply in the manner that the jet nozzles are at a different distance from the inner bottom edge. This can be achieved by an inclined arrangement of the distributor pipe with the jet nozzles connected thereto. The partial arrangement of the jet nozzles leads, in this connection, to no barrier to flow of the treatment liquid discharging from the container. The removal of sludge is therefore not prevented. It is conceivable that the liquid jet which has been introduced at the same time effect, in whole or in part, the moistening of the content of the container (treatment agent).

The discharge effect of the particles of filling material which have penetrated into the separating gap can be improved in simple manner by having the jet nozzle discharge into a niche located in front of it in the wall of the separating gap. As soon as the particles enter the niche, they are no longer entrained; they are freed and can be moved back better into the inside of the container by the water jet.

In order that the niche does not lead to a widening of the gap extending from the inside of the container, it lies at a distance from the inner bottom edge. It is possible to combine the water-jet solutions with one of the aforementioned variants or to combine all or some of them with one another. For example, the brush solution can be used together with the water-jet solution on one and the same centrifugal-force vibratory grinding machine.

BRIEF DESCRIPTION OF THE DRAWINGS

With the above and other objects and advantages in view, the present invention will become more clearly understood in connection with the detailed description of a preferred embodiments, when considered with the accompanying drawings, of which.

DETAILED DESCRIPTION OF THE PREFERRED EMBODIMENTS

Figure 1:
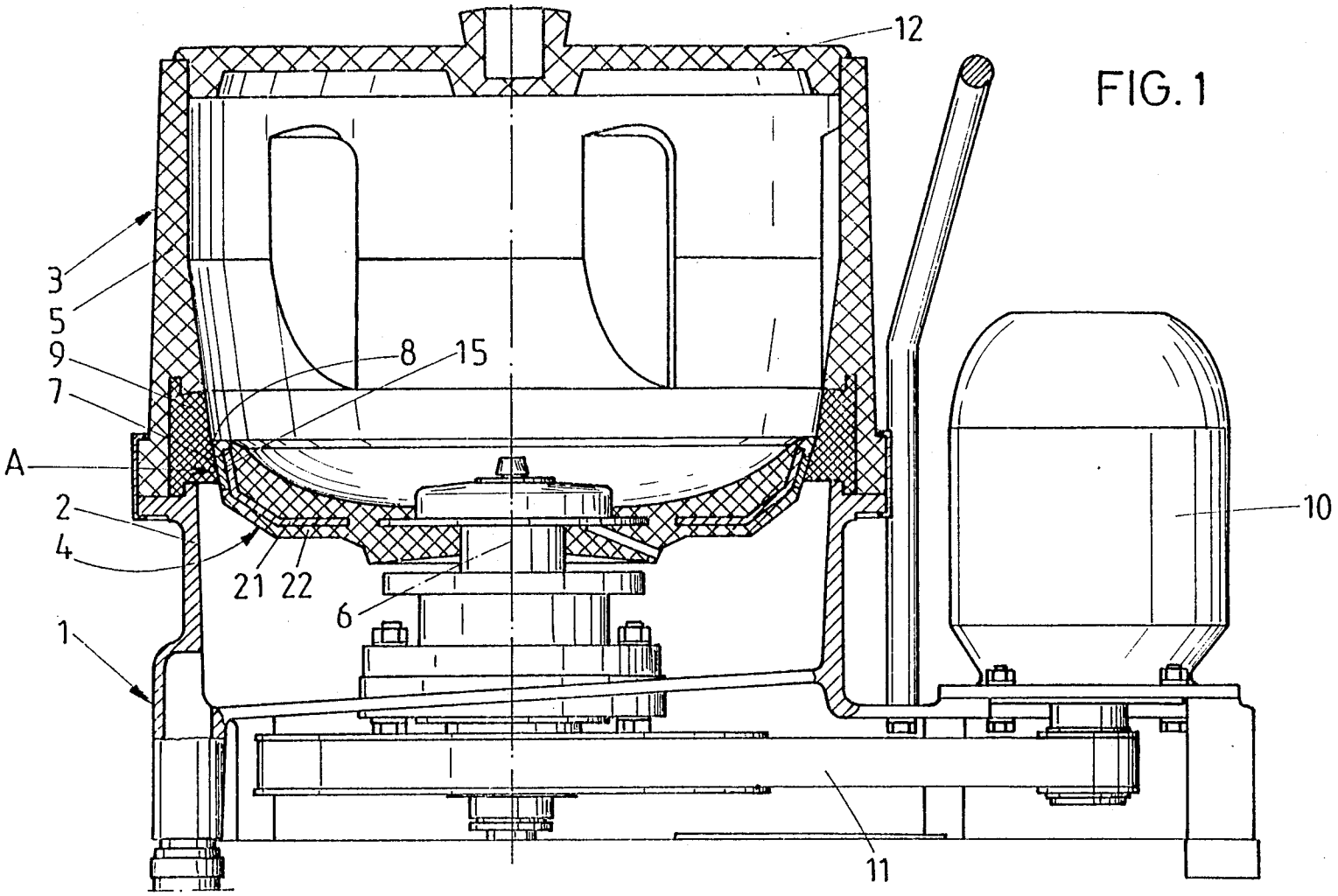
FIG. 1 is a partial longitudinal section through a centrifugal-force vibratory grinding machine in accordance with the first embodiment, the discharge element which is developed in the form of a projection being hard-metal (carbide) tips.

Part of the centrifugal-force vibratory grinding machine is a support frame 1 which is swingable around a horizontal axis, not shown. It has a flange 2, adjoining which there is a container 3 consisting preferably of polyurethane. Its bottom 4 rotates relative to the wall of the container 5 around a vertically directed container shaft 6. Between bottom 4 and container wall 5 a separating gap 7 is formed. The gap extends in ascending direction towards the inner bottom edge 8. This means that the bottom 4—seen in cross section—is frustoconical in shape at least at the height of the separating gap 7 so that the base faces the inside of the container.

At the height of the separating gap 7, the container wall 5 is provided with an annular lining 9 which is highly wear-resistant and possibly permits replacement.

The bottom 4, on its part, is developed in dish shape in such a manner that the container wall 5 adjoins the base of the dish.

The container 3 receives filling material (not shown) consisting of workpieces and working bodies, with the addition of treatment liquid. For the surface working of the workpieces, a drive motor 10, fastened on the support frame 1, drives the bottom 4 via a belt drive 11. The mixture of working bodies, workpieces and treatment liquid is pressed by the rotating bottom 4 against the container inner wall of the container 3 and conveyed upwards. From there it slides back towards the center of the rotating bottom 4. As a result of the rotation of the bottom 4, an annular bead, formed of the content of the container and carrying out a helical movement, is produced in the container 3.

As shown in FIG. 1, during the working of the workpieces, the container can be closed by a cover 12.

Figure 2:
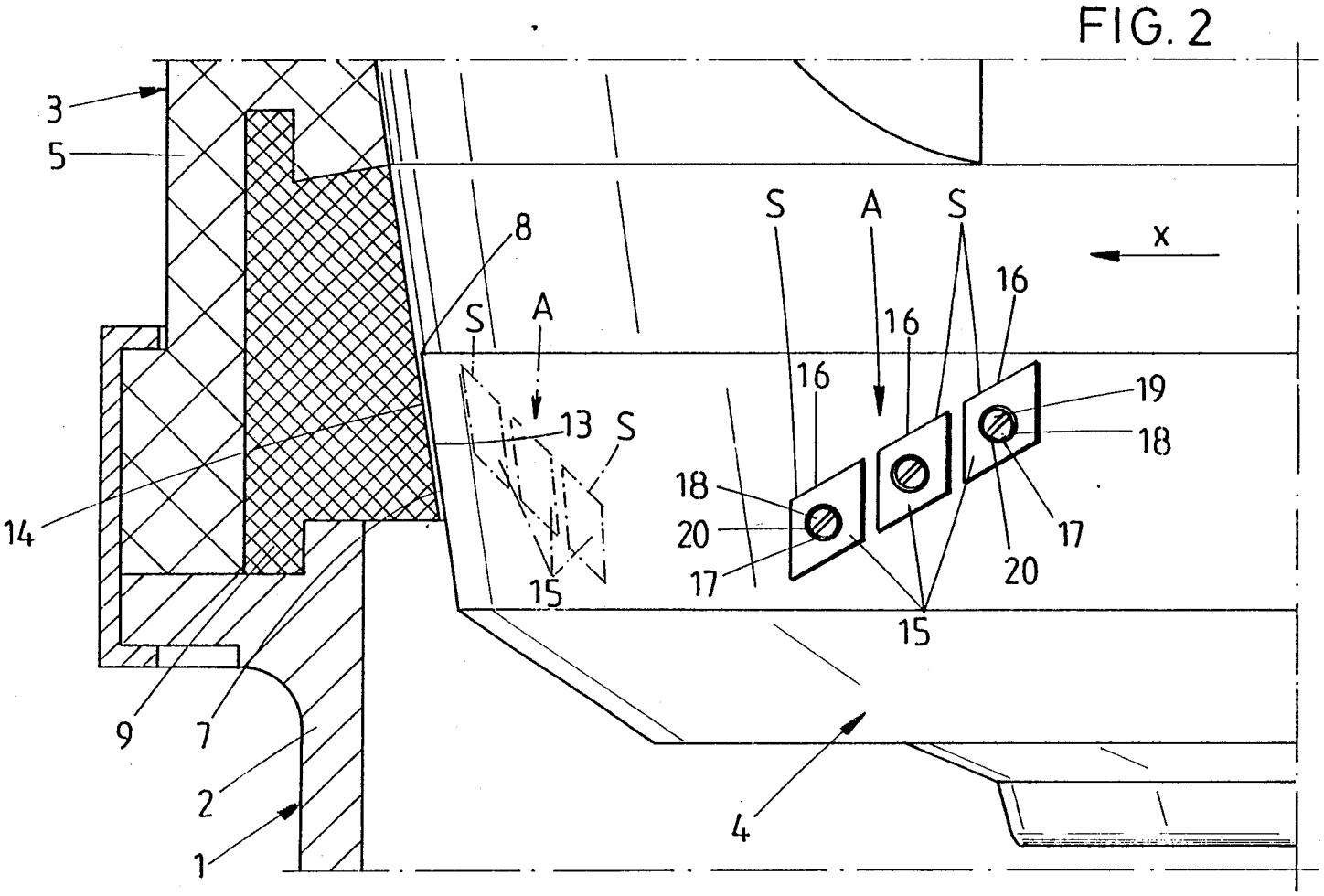
FIG. 2 shows on a larger scale a portion in the region of the container wall and of the bottom with hard-metal tips fixed in the wall thereof.
Figure 3:
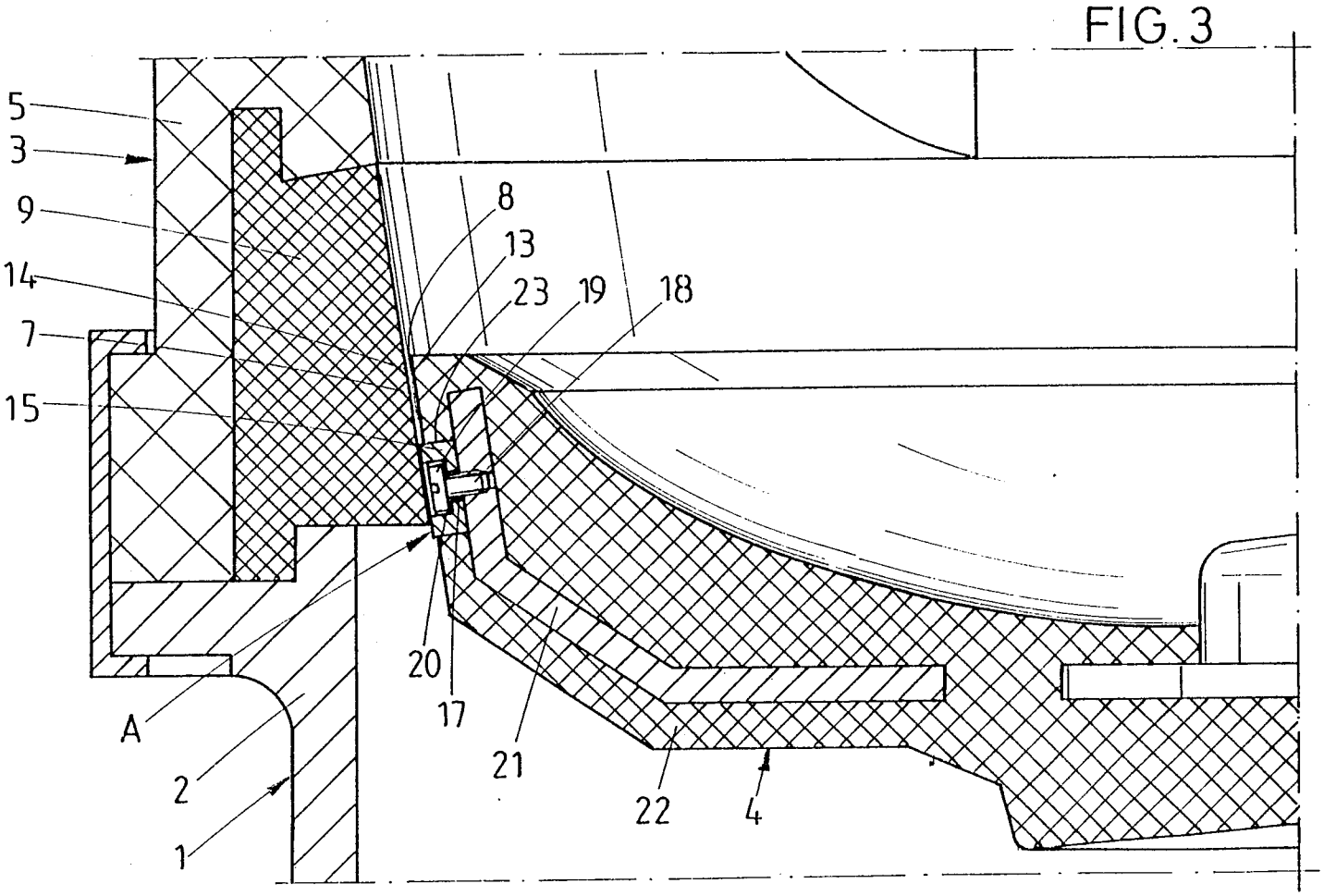
FIG. 3 is a vertical section through the container and bottom in the region of a hard-metal tip.

In order to prevent particles of filling material of separating-gap width which have entered the separating gap 7 from continuously rotating within the separating gap and thus promoting the wear of the facing walls 13, 14 of bottom 4 and lining 9, discharge elements A in the form of projections, in their turn shaped as hard-metal tips 15, are provided, in accordance with FIGS. 1 - 3. At the height of the separating gap 7, there are provided three hard-metal tips 15 arranged in rows one behind the other, they having a parallelogram shaped contour. In this way, the upper parallelogram edges 16 form a knife edge S which rises contrary to the direction of rotation x towards the inner bottom edge 8. This has the appearance that the knife edge S of the lower hard-metal tip 15 is at a greater distance from the bottom edge 8 than the knife edges of the higher-lying hard-metal tips 15. For the attachment of each hard-metal tip 15 it has a bore 17 through which an attachment screw 18 passes. In order that the head 19 thereof does not extend above the tip 15, it lies within a depression 20 in the bored hole 17 of the hard-metal tip 15. The shank end of the attachment screw 18 is screwed into a reinforcement insert 21 of the bottom 4, which has a plastic jacketing 22. As shown in FIG. 3, the hard-metal tip 15 lies in a recess 23 in the wall 13 of the separating gap 7. The wall 13 is the wall of the bottom 4. The recess 23 extends up to the reinforcement insert 21 so that the hard-metal tip can be clamped against it. The securing of the hard-metal tip against rotation is obtained in this connection by the recess 23.

The protrusion of the hard-metal tips 15 is somewhat less than the width of the gap. If particles of filling material enter the separating gap they travel in it only until they are picked up and comminuted by the hard-metal tips 15. The danger of the enlarging of the separating gap by the comminuted particles then is no longer present, the particles being swept out with the treatment liquid. The particles of filling material may also possibly be brought back by the ascending knife edges 16 of the hard-metal tips 15 into the inside of the container.

Instead of fastening the hard-metal tips by screws, they could also be fastened, in addition or exclusively, by bonding.

Figure 4:
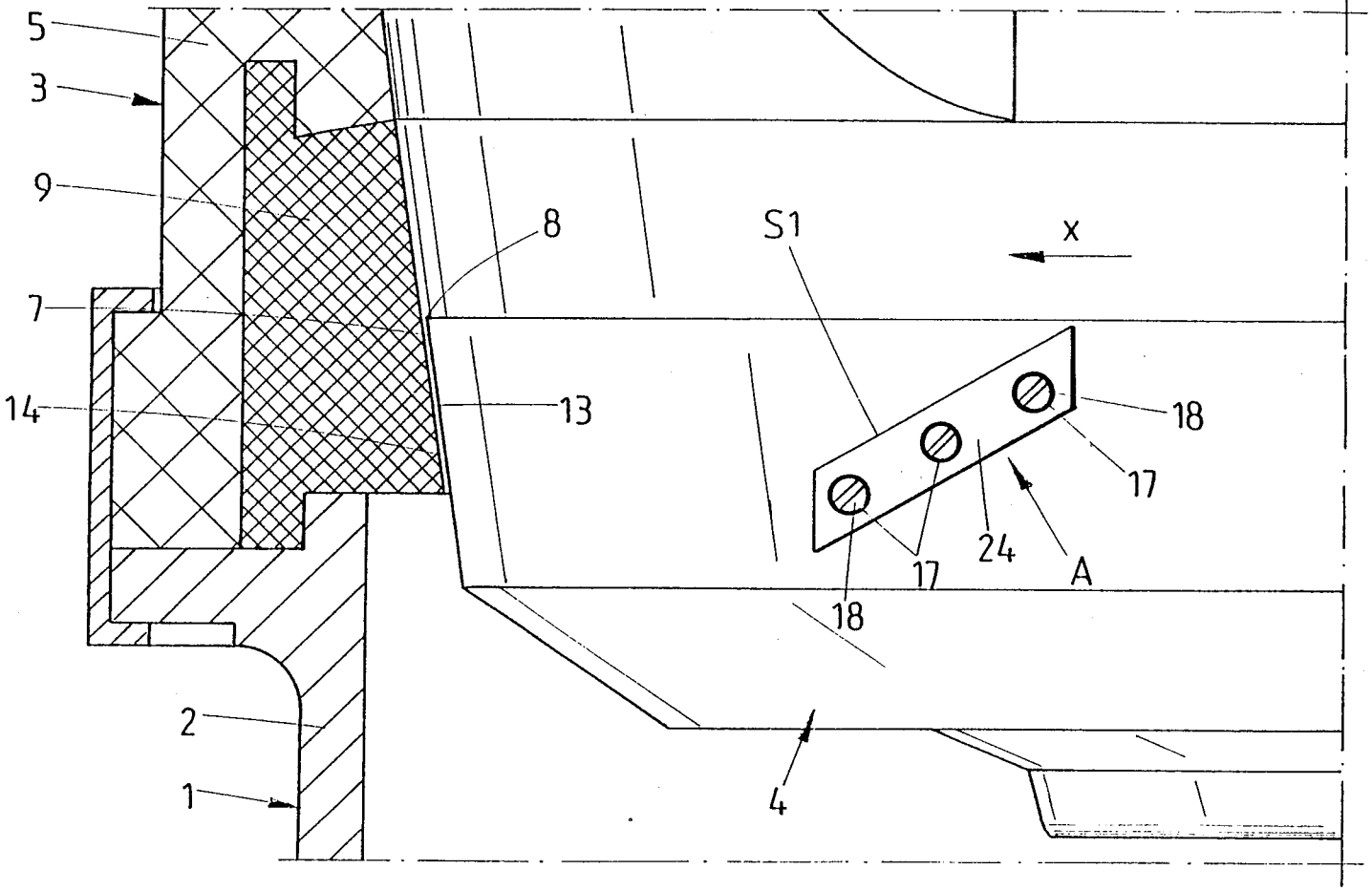
FIG. 4 is a showing corresponding to FIG. 2 in which a single elongated hard-metal tip is provided on the bottom, with a modified form of a hard-metal tip solution.

The hard-metal-tip solution shown in FIG. 4 differs from that described above in the manner that several hard-metal tips are combined to form a single elongated hard-metal tip 24. A continuous knife edge S1 of the same direction is now present. This elongated hard-metal tip 24 is fastened by three attachment screws 18 in equivalent manner to the bottom 4. Otherwise, the same structural parts bear the same reference numbers.

In both of the above two embodiments it is possible to arrange several hard-metal tips, distributed around the circumference, on the bottom. The hard-metal tips could also be provided on the wall 14 of the container 3. As can be noted from the dot-dash showing in FIG. 2, the hard-metal tips 15 can also be so aligned that their knife edges S ascend in the direction of rotation x towards the inner bottom edge 8. As alternative, it would be possible to use two rows of hard-metal tips 15, the knife edges of the one row ascending in the direction of rotation of the bottom 4 and the knife edges of the other row in opposite direction. Instead of arranging both knife edges on the bottom 4, they could also be arranged on the container. Another possibility could be achieved by fixing one row of the hard-metal tips with corresponding alignment on the bottom and the other row with corresponding alignment on the container.

Figure 5:
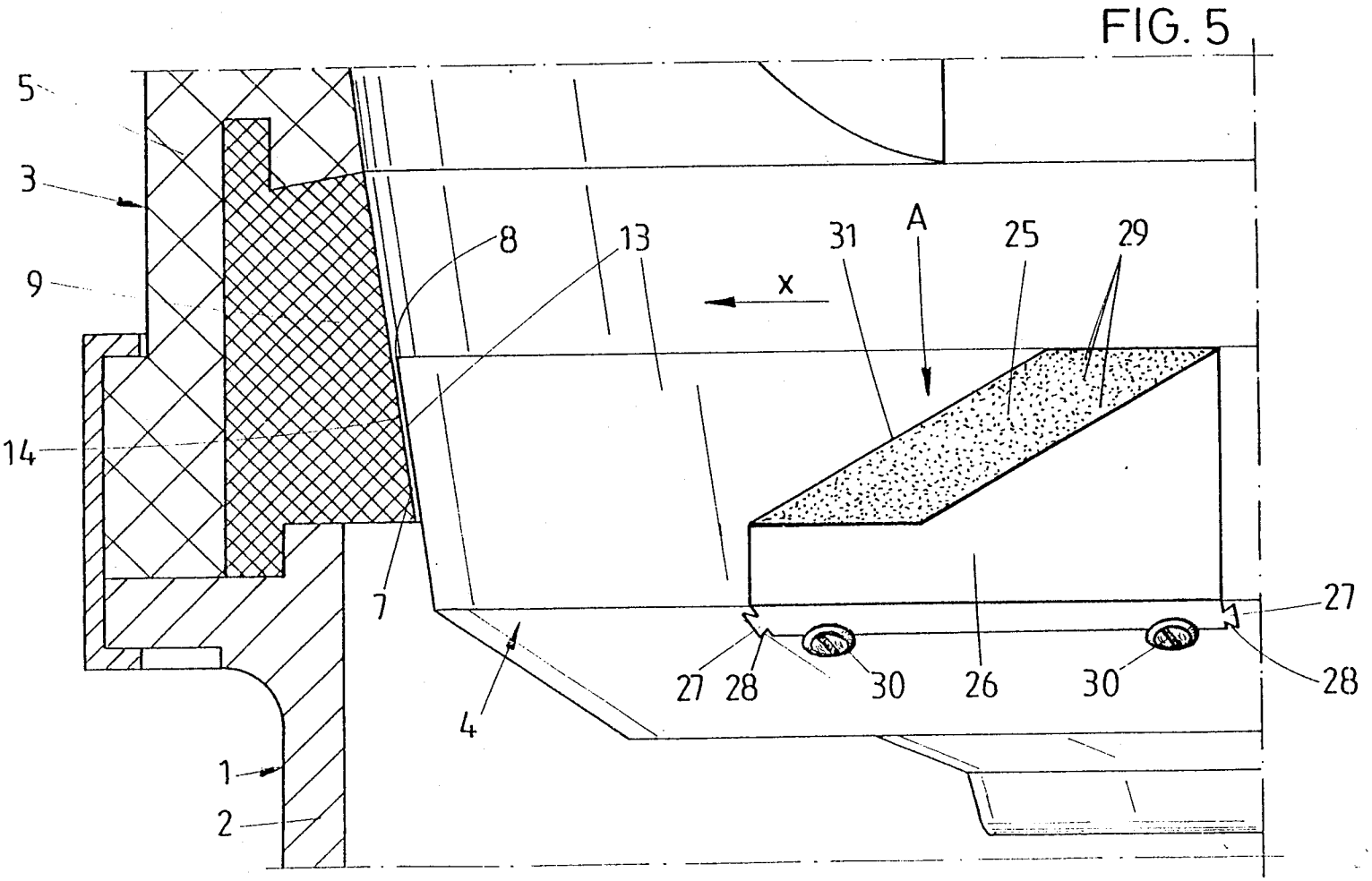
FIG. 5 is a showing corresponding to FIG. 4 in which the discharge element associated with the bottom is developed as a brush.
Figure 6:
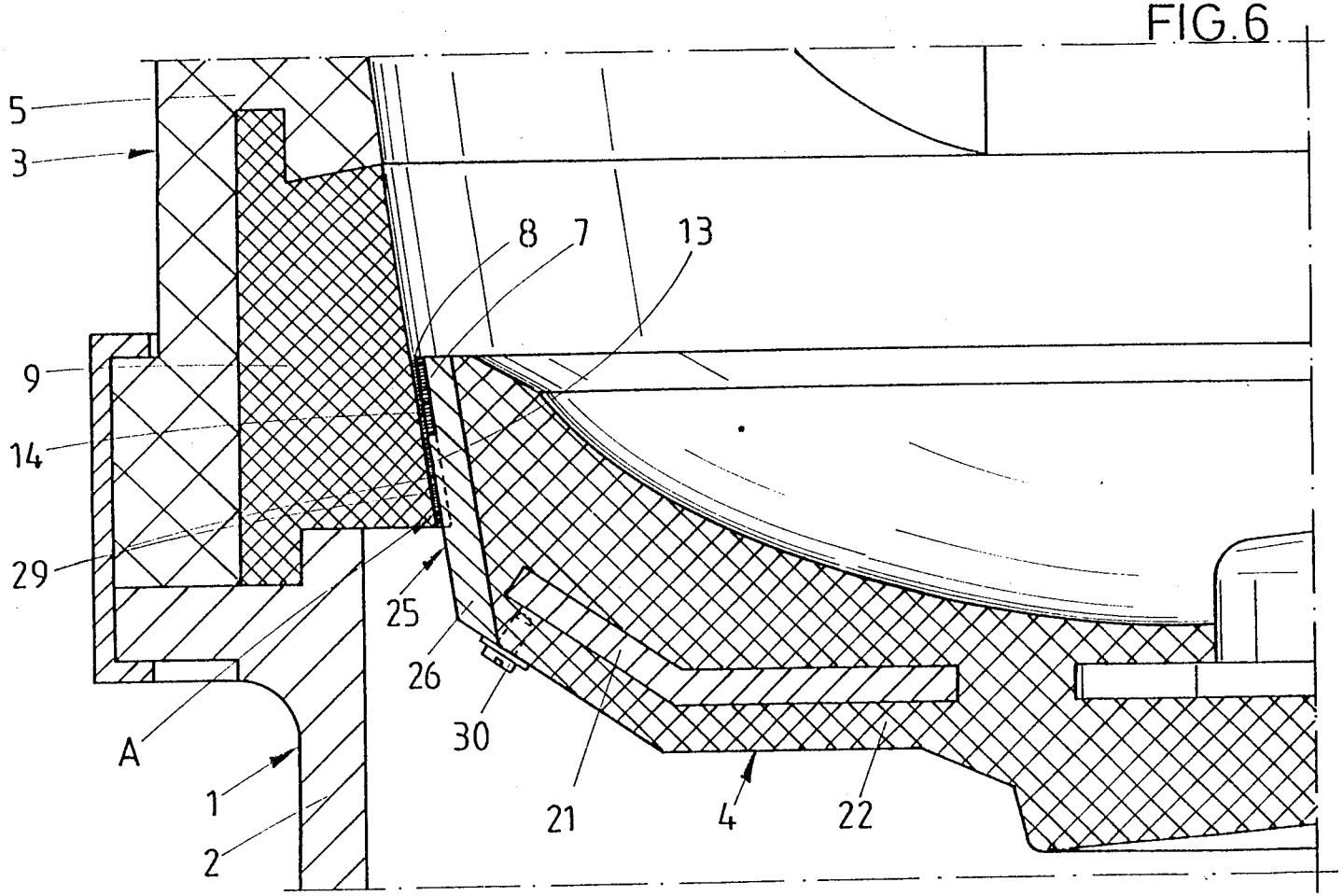
FIG. 6 is a vertical section through FIG. 5 at the height of the brush.

In the case of the modified structural form shown in FIGS. 5 and 6, the same structural parts also bear the same reference numbers. Differing from the embodiments described above, the discharge element A is now developed as a brush 25. It is located on a replaceable section 26 of the wall 13 of the bottom 4. This section 26 is provided in the direction of insertion with lateral dovetail sections 27 which engage in correspondingly undercut grooves 28 of the wall 13. In this way, the section 26 is held in radial direction on the bottom 4. Provision (not shown) can possibly be made in order to make the brush 25 adjustable from the lower side of the bottom. The inserted position of the brush 25 having bristles 29 is secured by screws 30, which are screwed into the bottom 4.

As shown in FIG. 5, the brush 25 has a run-on bevel 31 which rises in direction opposite the direction of rotation x up to the inner bottom edge 8. Furthermore, the run-on bevel 31 extends over the entire height of the separating gap 7. Assurance is thus had that particles of filling material which come into the region of the brush 25 are conveyed out of the separating gap.

Figure 7:
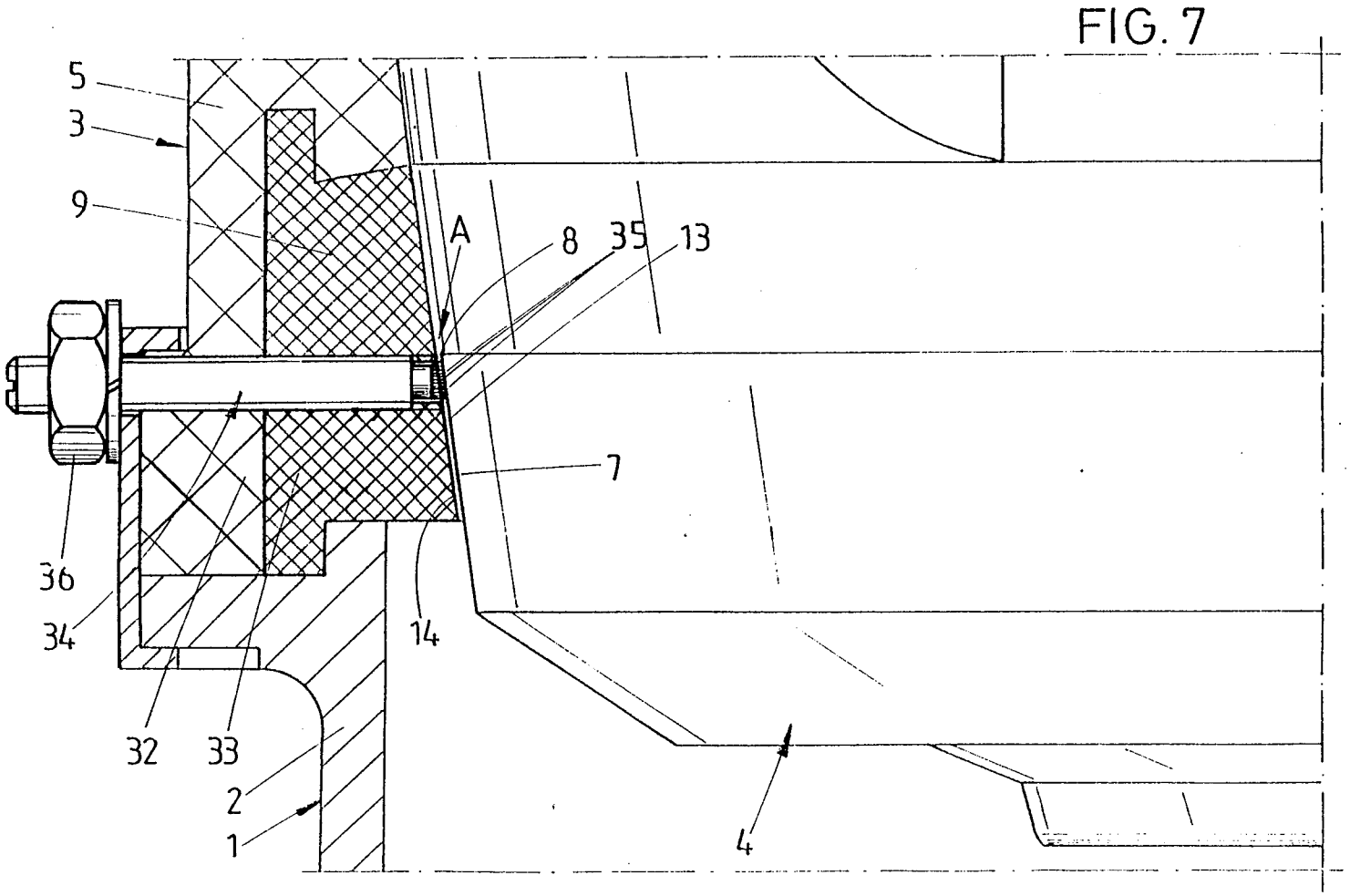
FIG. 7 is a vertical section in the case of another brush solution.

Another brush solution is shown in FIG. 7. At the height of the separating gap 7, adjacent to the bottom edge 8, the container wall 5 is traversed by a threaded bore hole 32. The latter serves to receive a brush body 34 which is provided with an external thread 33 and the inner end of which receives the bristles 35 which extend into the separating gap 7. A lock nut 36 resting against the outside of the container wall 5 secures the screwed-in position of the brush body 34. The bristles 35 are formed of wear resistant bristle material. After possible wear, readjustment of the brush body 4 in radial direction is, however, possible. Several such brush bodies 34 may be provided in the manner that they lie one behind the other and are arranged at different heights so that an ascending course in the direction opposite the direction of rotation of the bottom results. The larger particles of filling material which penetrate into the separating gap 7 are then removed by one or more brush bodies.

Figure 8:
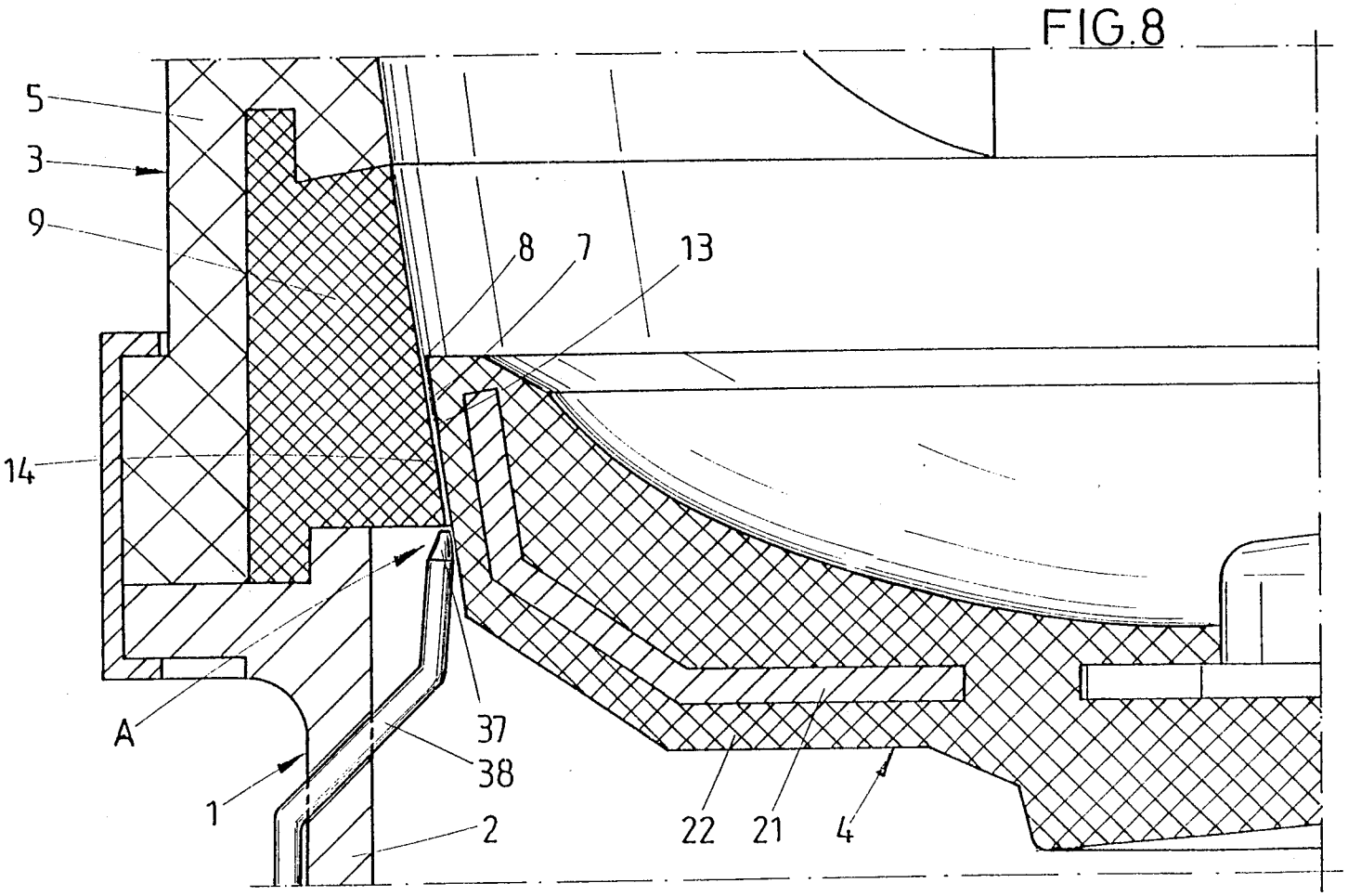
FIG. 8 is a vertical section through the container corresponding to the preceding figures in which a stationary jet nozzle, extending in the direction of the separating gap, is provided.

In accordance with the embodiment shown in FIG. 8, the removal element A is a water jet which is atomized under pressure into the separating slot 7. The jet of water in this case proceeds approximately in the direction of the separating gap 7 and is aligned in direction towards the inside of the container. For the formation of the water jet there serves a stationary jet nozzle 37 which is located on the end of a pipe 38 which passes through the flange 2. Instead of a single jet nozzle 37, several of them arranged at equal circumferential distances apart could, however, also be provided. The water jet which forms the discharge element and passes out of the jet nozzle 37 has the result that particles of filling material of corresponding grain size which enter into the separating gap 7 are conveyed into the inside of the container.

Figure 9:
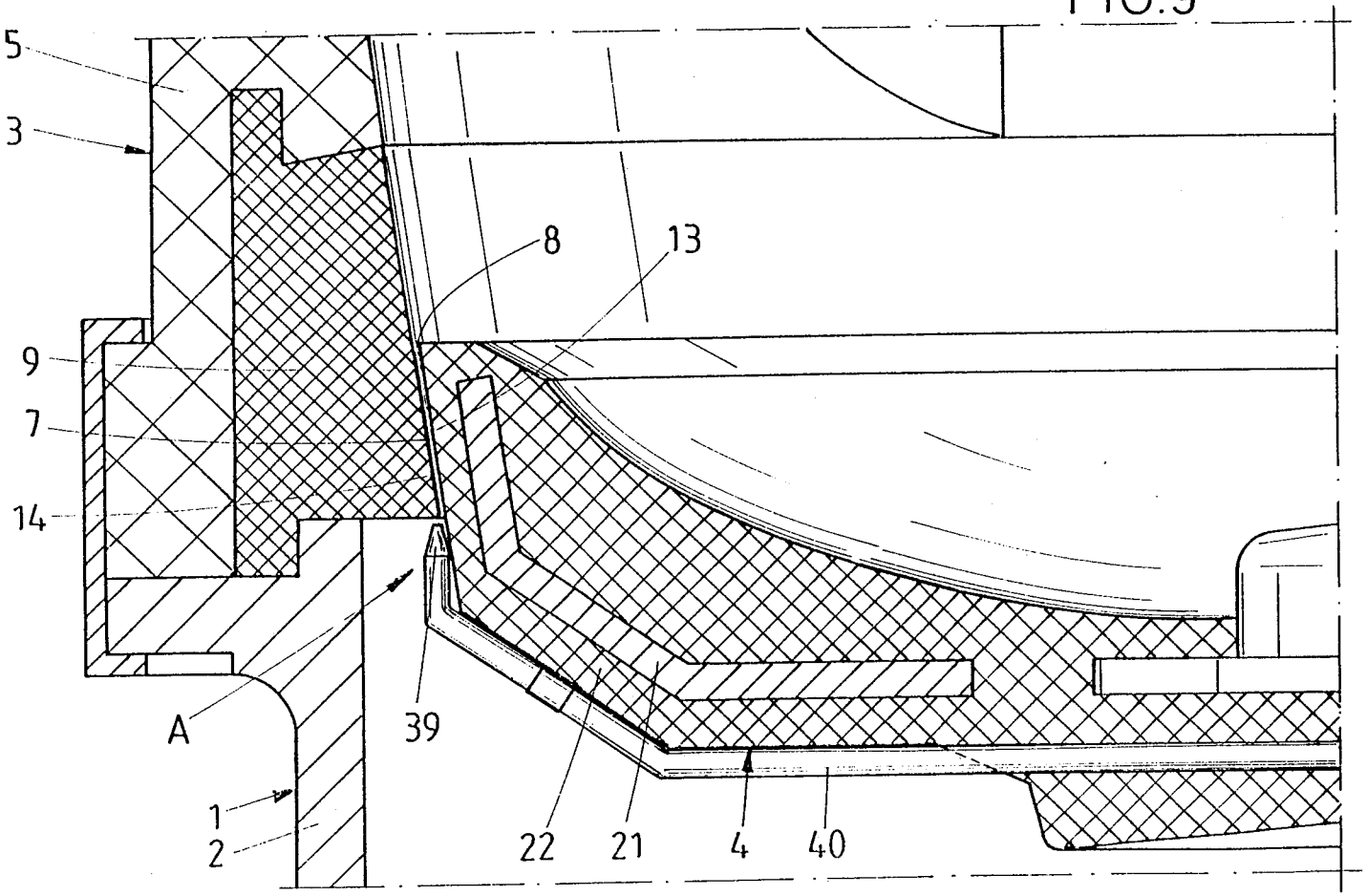
FIG. 9 is a showing corresponding to FIG. 8 in which the jet nozzle rotates with the bottom and is directed towards the separating gap.

In accordance with the modified water-jet solution of FIG. 9, the jet nozzle 39 rotates with the bottom 4. The jet nozzle 39 extends closely below the separating gap 7 and serves for the loosening of the jammed particles of filling material and their return into the inside of the container. The jet nozzle 39 is seated on the end of a pipe 40 which is fixed in suitable manner on the bottom 4 and is fed via a central conduit (not shown) in the container shaft 6. Here, also, there is the possibility of arranging several nozzle jets 39 at an angle to each other.

Figure 10:
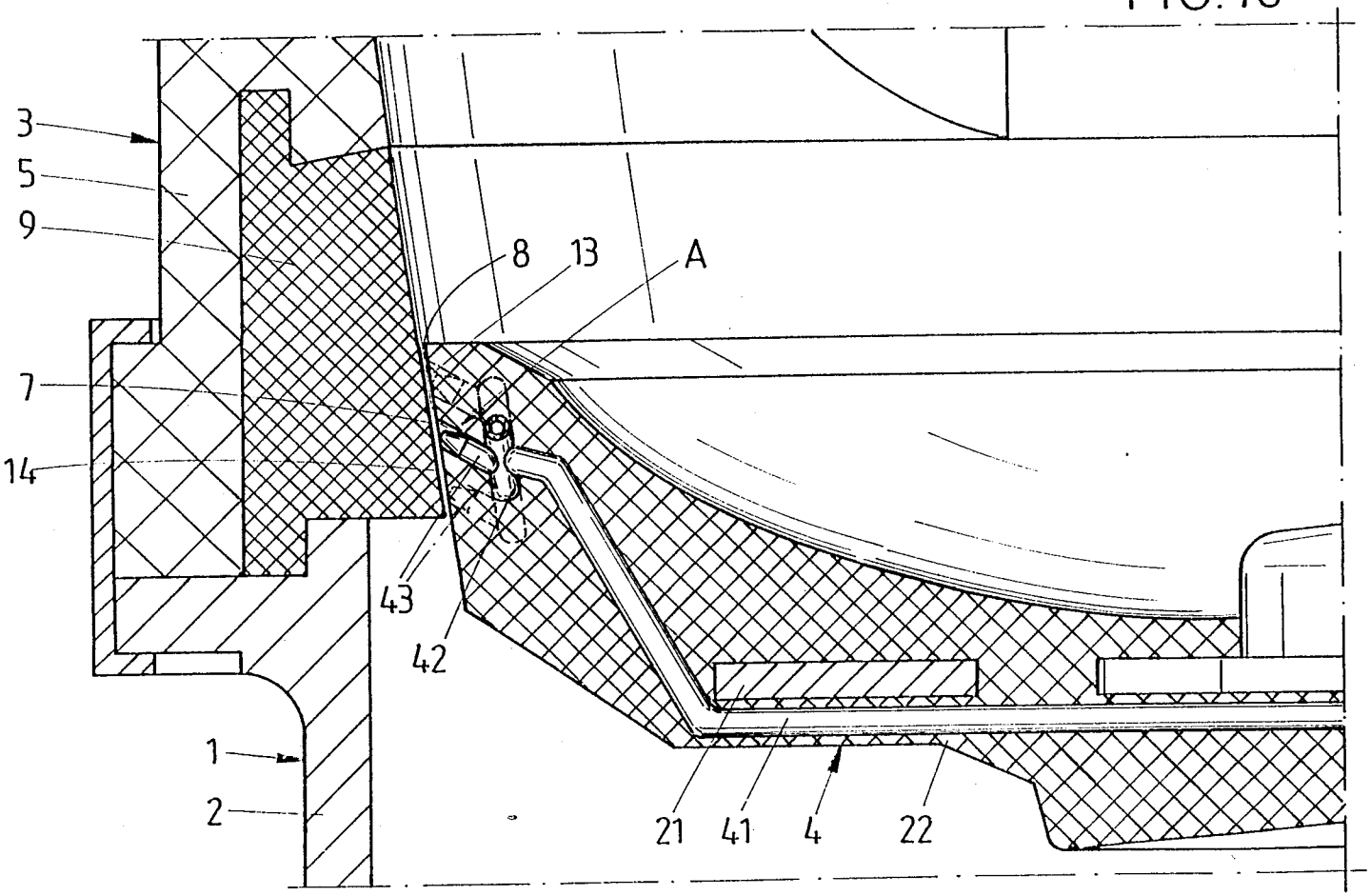
FIG. 10 is a further embodiment of the water-jet solution in which a plurality of jet nozzles, connected to a distributor pipe of the bottom are provided.

In accordance with the modified variant of the water-jet solution shown in FIG. 10, a pipe 41 is embedded in the bottom 4. The pipe leads to a distributor pipe 42 which lies at the height of the separating gap 7 and from which three jet nozzles 43 extend which, in their turn, debouch into the separating gap 7 in such a manner that the jet of water exerts a component of force in upward direction so as to throw the larger particles which have entered into the separating gap out of it. The distributor pipe 42 makes possible a different spacing of the three nozzle jets 43 with respect to the inner bottom edge 8 so that, in addition, a conveyance component is produced in upward direction and therefore into the inside of the container. The position of the jet nozzles 43 one above the other and the oblique position of the distributor pipe 42 can be noted from FIG. 11.

Figure 11:
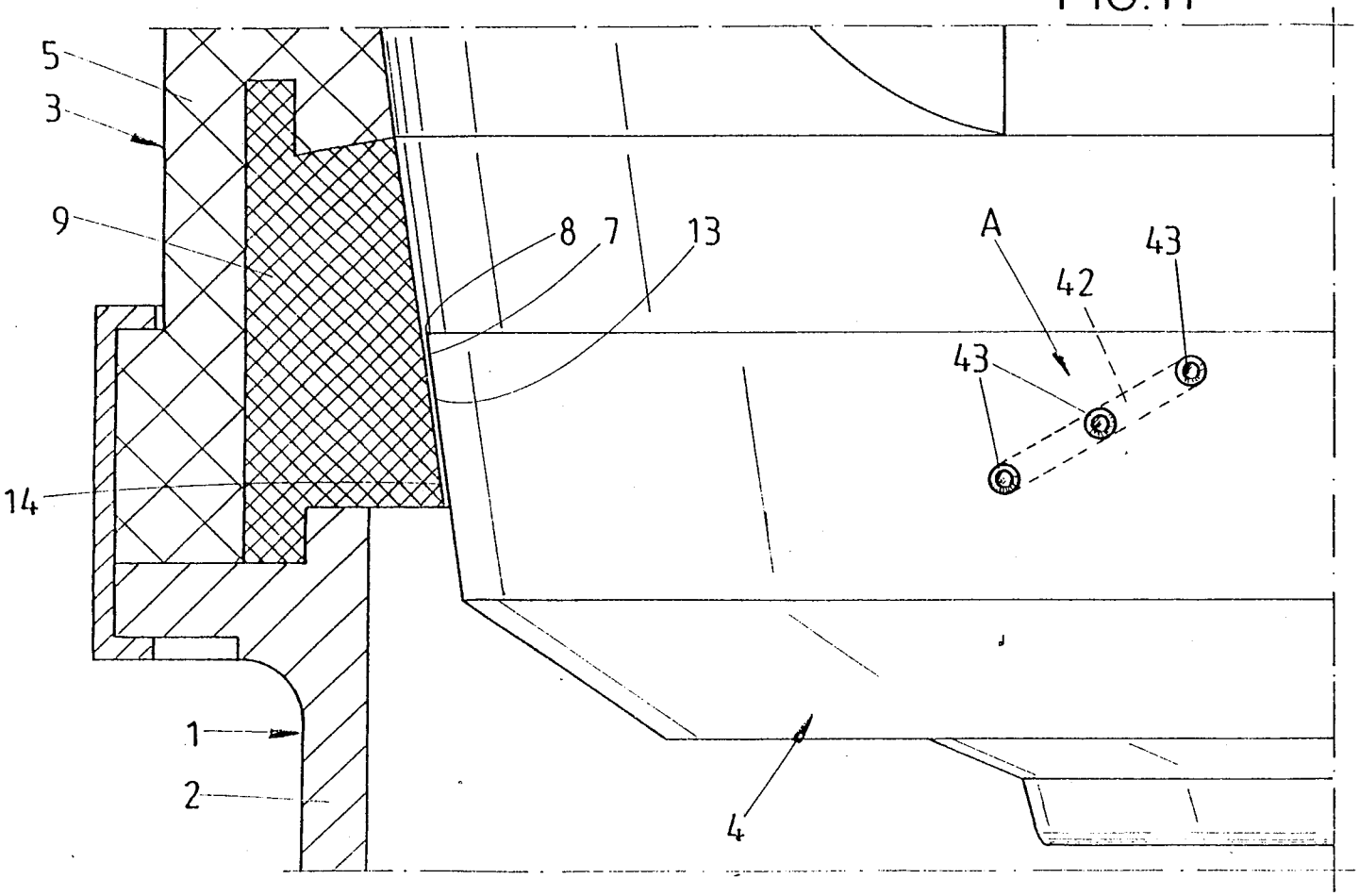
FIG. 11 shows the solution according to FIG. 10, partly in elevation and partly in section.
Figure 12:
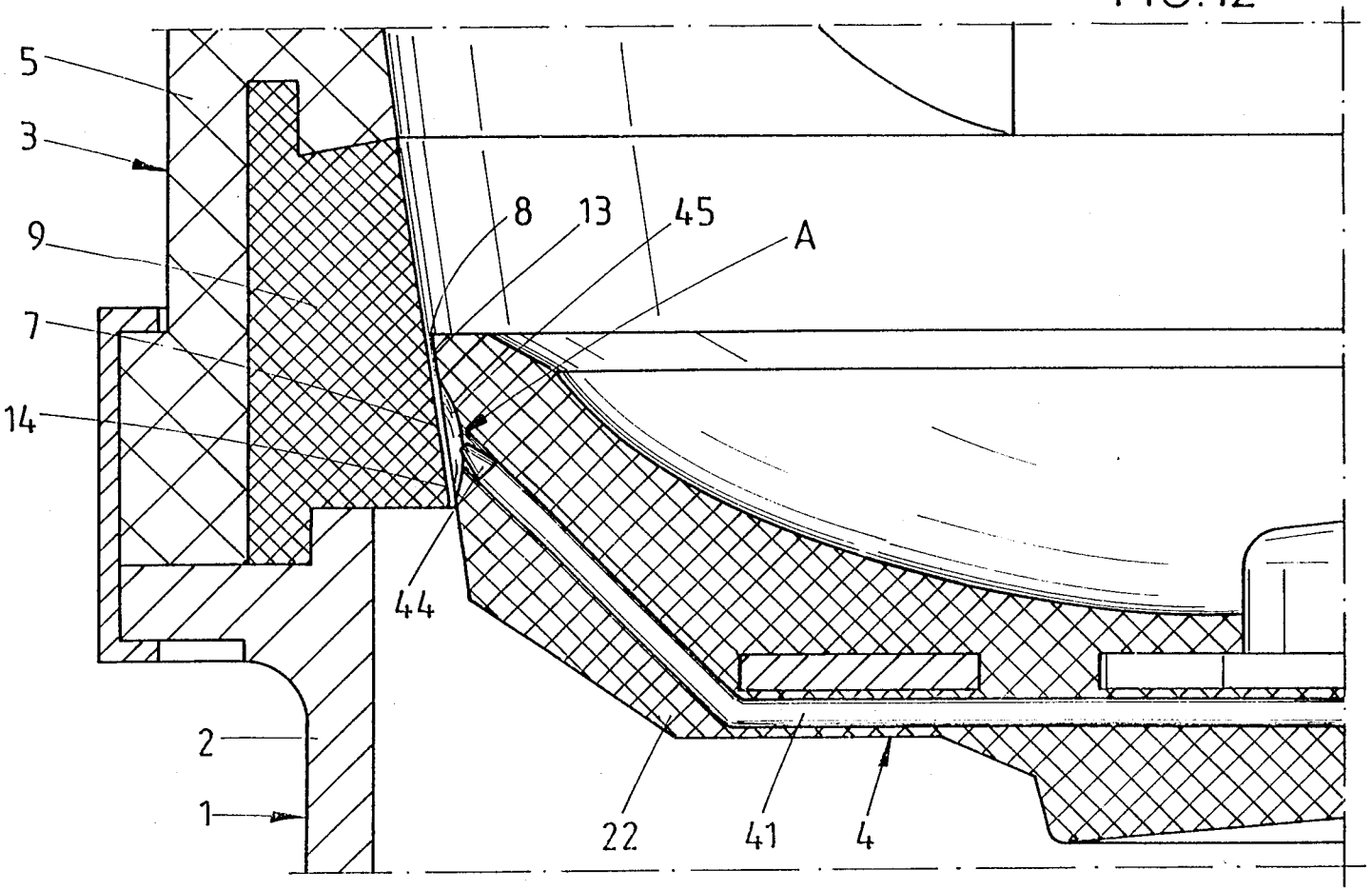
FIG. 12 is another modified water-jet solution in which the jet nozzle discharges into a niche in the wall of the separating gap which is arranged in front of it.

The embodiment in accordance with FIG. 12 substantially corresponds to the embodiment according to FIGS. 10 and 11. The pipe 41, which is embedded in the bottom 4, terminates in a jet nozzle 44. The latter debouches into a trough-like niche 45 in the wall 13 of the separating gap 7, said niche being located in front of it. The niche 45 is spaced from the inner bottom edge 8. If larger particles pass through the gap 7 into the niche 45, they are first freed so that then the unbraked particles can be deflected back by the water jet into the inside of the container. Also in this solution there is the possibility of providing several of such jet nozzles 44 and niches 45 on the bottom 4.

Figure 13:
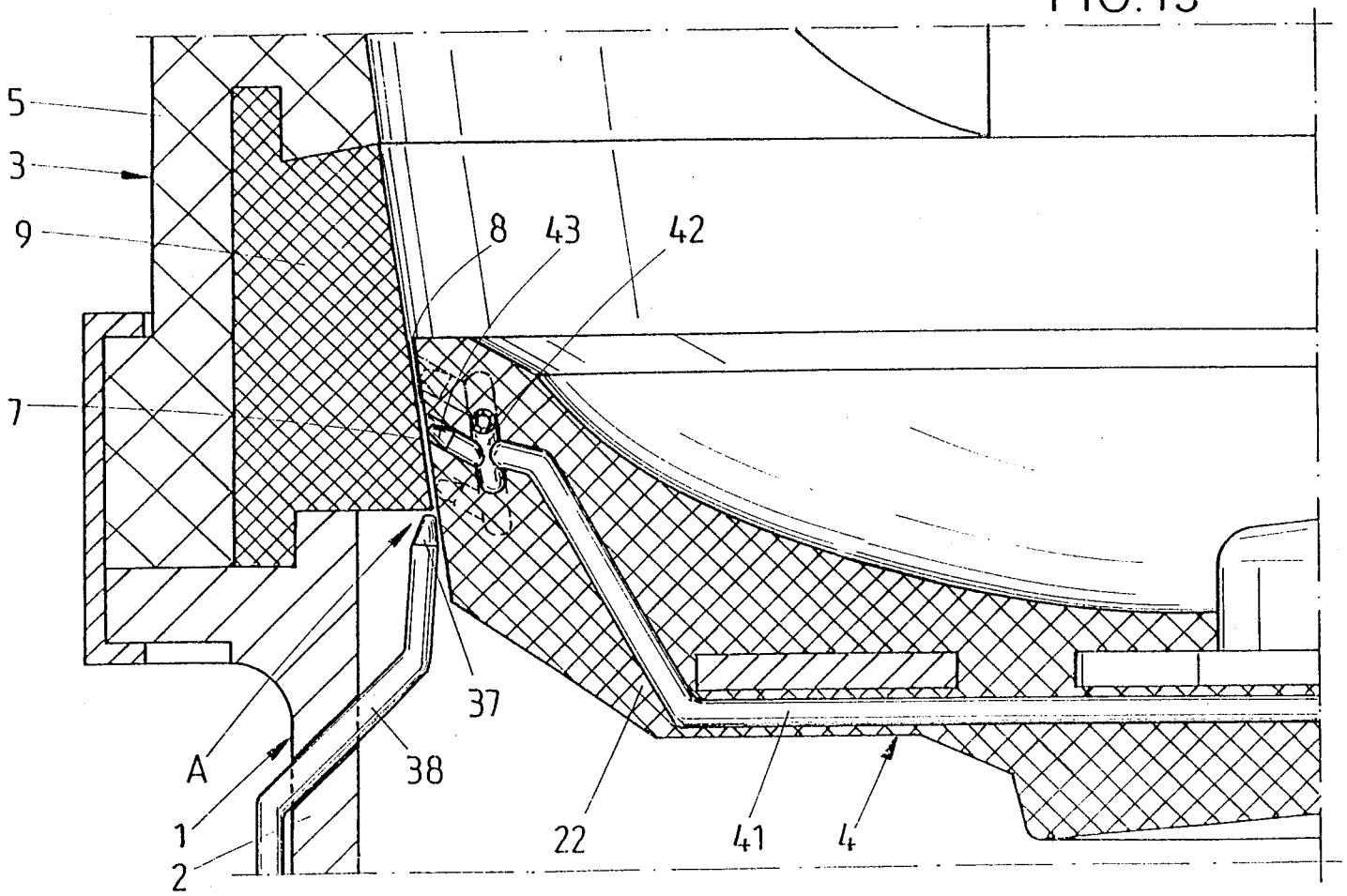
FIG. 13 is a vertical section through the container showing the combination of a stationary and a rotating jet nozzle.

A combination solution can be noted from FIG. 13. The bottom 4 corresponds in its construction to the embodiment according to FIGS. 10 and 11. This means that it is provided with the corresponding jet nozzles 43 and a distributor pipe 42. Furthermore, there is a jet nozzle 37, the arrangement and development of which correspond to the embodiment according to FIG. 8. The jet nozzles 37 and 43 are, however, seen in circumferential direction, staggered with respect to each other so that they do not interfere with each other and deflect the jet of water unimpeded onto possible particles so as to convey them out of the separating gap.

Figure 14:
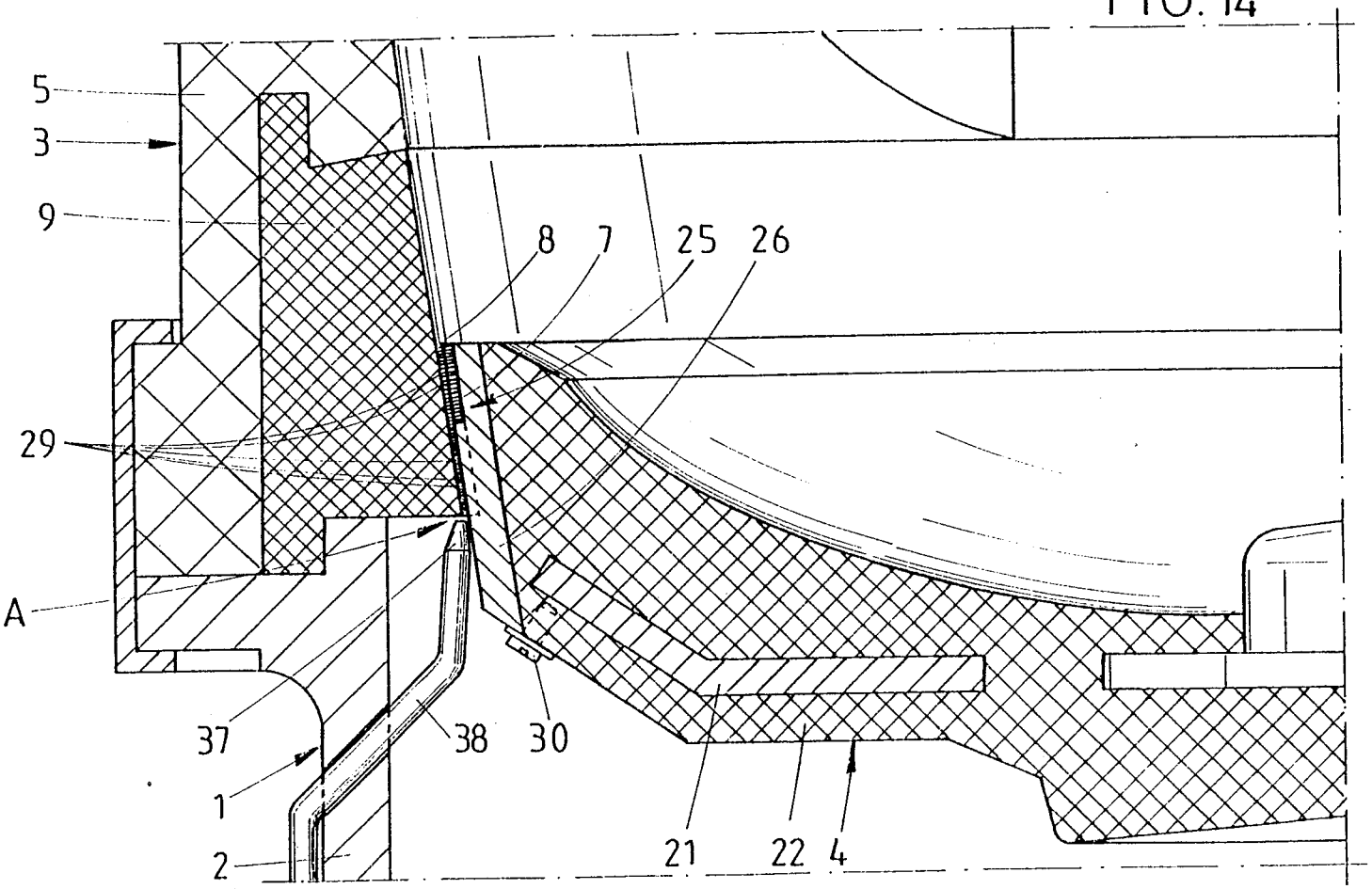
FIG. 14 is also a vertical section which shows the combination of the brush and water-jet solutions.

The combination solution shown, finally, in FIG. 14 has a stationary jet nozzle 37 in accordance with FIG. 8. Furthermore, the bottom 4 is provided with a brush 25 in accordance with FIGS. 5 and 6. In this case, also, there is a stagger between jet nozzle 37 and brush 25 in circumferential direction.

Further combinations would be possible, all of which have the common goal of considerably shortening the time of stay of larger particles of filling material which have entered the separating gap while reducing the wear of the separating gap to a minimum.

I claim:

1. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom; and said discharge element has an edge positioned for engagement with the particles which have entered into said gap, said edge being inclined relative to a plane of rotation of said bottom for deflecting the particles out of said gap.

2. A centrifugal-force vibratory grinding machine according to claim 1, wherein the discharge element is developed as a projection located on a surface of the gap and protrudes into the gap.

3. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom;

the discharge element is developed as a projection located on a surface of the gap and protrudes into the gap; and wherein the projection has a knife edge which points in the direction opposite a direction of movement of the particles of filling material.

4. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom;

said discharge element comprises a projection which protrudes into said gap and is formed by at least one hard-metal tip.

5. A centrifugal-force vibratory grinding machine according to claim 4, wherein the hard-metal tip has a fastening screw and at least one bore hole which is traversed by the fastening screw, a head of the screw lying within a depression of the bore hole.

6. A centrifugal-force vibratory grinding machine according to claim 5, wherein the container bottom has a reinforcement insert and a plastic covering over the reinforcement insert; and a shank end of the fastening screw is screwed into the reinforcement insert.

7. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom;

said discharge element comprises a projection which protrudes into said gap; and said projection has a knife edge which extends at an inclination to a plane of rotation of the container bottom in such a manner that the knife edge ascends opposite to or in a direction of rotation towards an inner edge of said bottom.

8. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom;

said discharge element comprises at least two projections which protrude into said gap; and said projections are each provided with knife edges which are so inclined to a plane of rotation of said bottom that one ascends opposite a direction of rotation and the other ascends in the direction of rotation towards an inner edge of said bottom.

9. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom, and said discharge element comprises a plurality of hard-metal tips arranged in a row one behind the other.

10. A centrifugal-force vibratory grinding machine according to claim 9, wherein each hard-metal tip has a parallelogram-shaped contour.

11. A centrifugal-force vibratory grinding machine according to claim 9, wherein there is a recess in a wall of the gap; and the hard-metal tip lies in part in the recess.

12. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom; and said discharge element is developed as a brush which extends from at least one wall of the separating gap.

13. A centrifugal-force vibratory grinding machine according to claim 12, wherein the brush extends up to an edge of the container bottom.

14. A centrifugal-force vibratory grinding machine according to claim 12, wherein the brush is adjustable and replaceable.

15. A centrifugal-force vibratory grinding machine according to claim 12, further comprising a replaceable section of a wall of said separating gap, said replaceable section being held radially by means of guides and being adapted to be inserted from a lower side of the container bottom; and wherein said brush is disposed in said replaceable section.

16. A centrifugal-force vibratory grinding machine according to claim 12, wherein the brush is located on a wall of the gap formed by one of said container components.

17. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom;

said discharge element comprises at least one threaded bore hole which traverses the container wall and leads to said separating gap; and a brush body provided with an external thread and having bristles on its end is screwed into the bore hole.

18. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap;

wherein said discharge element is fixed to one of said container components for movement relative to the other of said container components during rotation of the container bottom; and said discharge element comprises two brushes which extend over 360°.

19. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap;

wherein said discharge element is fixed to one of said container components for movement relative to the other of said container components during rotation of the container bottom; and said discharge element comprises two brushes, one of said brushes extending into said gap from said container wall and a second of said brushes extending into said gap from said container bottom.

20. A centrifugal-force vibratory grinding machine comprising a container which receives filling material consisting of workpieces and working bodies, the container being formed of two components of which one component is a wall of the container and the second component is a bottom of the container, he bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom; and said discharge element comprises at least one water jet which is atomized to direct water under pressure into the gap; and said at least one water jet positioned within said bottom and extending to said separating gap.

21. A centrifugal-force vibratory grinding machine according to claim 20, wherein there is a niche located in front of a jet in a wall of the separating gap; and the jet nozzle opens into the niche.

22. A centrifugal-force vibratory grinding machine according to claim 21, wherein the niche is spaced apart from an inner edge of the container bottom.

23. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom; and said discharge element comprises at least one water jet which is atomized to direct water under pressure into the gap; and said at least one water jet, the water being directed towards the inside of the container.

24. A centrifugal-force vibratory grinding machine comprising a container which receives filling material consisting of workpieces and working bodies, the container being formed of two components of which one component is a wall of the container and the second component is a bottom of the container, the bottom of the container being rotatable relative to the container wall around an axis of the container, there being a separating gap between the bottom and the wall of the container;

at least one discharge element for the removal of particles of filling material which have entered into said gap, said discharge element engaging into the space of the separating gap; and wherein said discharge element is fixed to one of said container components for movement relative to the other of said container components during rotation of the container bottom; and said discharge element comprises at least one water jet which is atomized to direct water under pressure into the gap; and a water jet comprises a plurality of jet nozzles, said jet nozzles being positioned within said bottom and extending to said separating gap, and a distributor pipe connected to the jet nozzles.

25. A centrifugal-force vibratory grinding machine according to claim 24, wherein the jet nozzles are at different distances from the inner edge of the container bottom.

* * * * *